United States Patent [19]

Cavanagh

[11] 4,413,431

[45] Nov. 8, 1983

[54] ATHLETIC SHOE UPPER CONSTRUCTION

[75] Inventor: Peter R. Cavanagh, Pine Grove Mills, Pa.

[73] Assignee: PUMA-Sportschuhfabriken Rudolf Dassler KG, Herzogenaurach, Fed. Rep. of Germany

[21] Appl. No.: 387,668

[22] Filed: Jun. 11, 1982

[51] Int. Cl.[3] ..... A43B 5/00; A43B 11/00

[52] U.S. Cl. ..... 36/114; 36/45; 36/50; D2/309

[58] Field of Search ..... 36/45, 50, 114, 126, 36/129; D2/309, 310, 311

[56] References Cited

U.S. PATENT DOCUMENTS

| | | | |
|---|---|---|---|
| D. 258,772 | 4/1981 | Norton et al. | D2/309 |
| 4,255,876 | 3/1981 | Johnson | 36/50 |
| 4,342,161 | 8/1982 | Schmohl | 36/50 |

*Primary Examiner*—Werner H. Schroeder
*Assistant Examiner*—Steven N. Meyers
*Attorney, Agent, or Firm*—Antonelli, Terry & Wands

[57] ABSTRACT

An athletic shoe upper construction comprises a vamp with an elongated throat opening and a one-piece reinforcement of non-stretchable material. The one-piece reinforcement has a lacing hole reinforcing portion which is secured to the vamp of the upper adjacent to and surrounding the throat opening, and medial and lateral reinforcing portions in the form of an elongated strip extending from the lacing hole reinforcing portion to the featherline of the vamp in the mid-tarsal region of the respective sides of the vamp. Additionally, the width and location of the respective medial and lateral reinforcing portions is sufficient to at least span respective holes of two pairs of lacing holes provided in the lacing hole reinforcing portion. According to a feature of a preferred embodiment, pairs of lacing holes provided in the lacing hole reinforcing portion comprise widely-spaced parts of holes and closely-spaced pairs of holes, the holes of the widely-spaced pairs being located closer to the featherline than the holes of the closely-spaced pairs. Furthermore, the holes spanned by the medial and lateral reinforcing portions are widely-spaced pairs of holes.

8 Claims, 2 Drawing Figures

ATHLETIC SHOE UPPER CONSTRUCTION

BACKGROUND OF THE INVENTION

The present invention relates to athletic shoes as are used for running, court sports, or the like. Particularly, the present invention relates to an upper construction for athletic shoes of the type which is provided with reinforcements for providing foot control.

It is known that each time that the foot of a runner contacts the ground, there is a force equal to about half the runner's body weight which makes the foot slip forward. While the friction between the outsole and the ground is high, such that the platform of the shoe stays fixed, the foot, if the upper does not provide adequate support, will move forward. This can result in damage to the toes and toenails, as well as irritation, of the top part of the foot. Additionally, it is known that lateral and medial motion of the foot can cause problems such as injury and fatigue, during running.

Accordingly, to restrict movement of the foot, various lacing arrangements and stabilizing members, such as reinforcing strips, have been devised. For example, early Dassler Brothers shoes (see page 34 of my book entitled *THE RUNNING SHOE BOOK,* Anderson World, Inc., 1980) and U.S. Pat. No. 3,138,880 show athletic shoes wherein each eyelet ring used for lacing is connected to the end of a narrow reinforcing strip which extends down the side of the shoe to the margin of the upper. These strips run approximately parallel to one another on each side of the upper and are stitched to the upper along their length. While such arrangements improve lateral stability of the athletic shoes to which they are applied, they do have several disadvantages. Firstly, since these reinforcing strips are relatively long (extending from the upper margin—or featherline—to narrowly set eyelet positions), they are subject to stretch, and only limited tension can be applied via lacing to these strips. Still further, since athletic shoes conventionally have from 4 to 7 pairs of lacing eyes, strips are provided over a major portion of the shoe between the toe and heel regions. This large number of strips over such a large area has several disadvantages, not the least of which is that they detract from the appearance (and thus the salability) of the shoe. They also interfere with comfortable fitting of the shoe and significantly increase the cost of its manufacture.

In a departure from the foregoing technique, U.S. Pat. No. 4,255,876 discloses an athletic shoe which seeks to restrict forward and lateral movement of the rear part of the foot through the use of a limited number of reinforcing strips that are not directly associated with each of the lacing eyes. In accordance with the construction of this patent, a reinforcing member surrounds a tongue opening of the upper in a zig-zag fashion with lacing holes being formed therein in a like fashion, so that alternating pairs of wide-set and narrow-set lacing holes are disposed along the length of the tongue opening. Additionally, on the medial side of the upper, extending from the lace hole reinforcing member to the featherline or margin of the upper, a reinforcing strip is placed at each of positions forwardly of and adjacent to the first metatarsophalangeal joint, and forwardly of and adjacent to the first metatarsal head or the ball of the foot. On the lateral side of the upper, a third strip similarly extends from the featherline to the lace hole reinforcing member at a position forwardly of and adjacent to the fifth metatarsophalangeal joint so as to urge the ball of the foot into the pocket or region located between the two strips that are located on the medial side of the shoe, for purposes of enhancing stability of the foot rearwardly of the toes, and preventing forward movement of the rear portion of the foot.

While the shoe construction of U.S. Pat. No. 4,255,876 may have beneficial characteristics, it does have certain disadvantages. Since the reinforcing strips are not directly connected with lacing eyes or holes, but rather are stitched to a separate lacing hole reinforcing member, stretching can occur and the amount of tension which can be applied by the laces to the foot via the reinforcing side strips is limited. The use of four separate reinforcing members increases the cost of manufacture, and as noted in greater detail below, the absence of any reinforcement on the lateral side of the upper rearward of the fifth metatarsophalangeal joint significantly is disadvantageous due to its affect of mid-foot stability.

More particularly, it has relatively recently been determined that, due to the physiological construction of the leg and foot, during running the foot of the runner does not strike the ground at the rear of the heel of the foot (as occurs during walking), but rather occurs along the lateral outer side of the foot. As a result, without proper or adequate foot control, the possibility exists that a runner's foot could literally fall off the edge of the shoe. The same holds true for runners who run on the inside edge of their shoe. Similarly, medially and laterally supporting mid-foot control is also important to athletes participating in court and other sports involving frequent lateral movements.

SUMMARY OF THE INVENTION

In view of the foregoing, the present invention has the objects of providing an improved athletic shoe upper construction which provides (a) a high degree of mid-foot control and support, (b) constructional simplicity, and (c) the associated factors of minimized manufacturing costs and overall appearance.

In accordance with a preferred embodiment of the present invention, these objects are attained by an athletic shoe upper construction which comprises a vamp with an elongated throat opening and a one-piece reinforcement of non-stretchable material that is secured to the vamp. The one-piece reinforcement includes a lacing hole reinforcing portion and medial and lateral reinforcement portions. The lacing hole reinforcing portion is secured to the vamp adjacent to and surrounding the throat opening, while the medial and lateral reinforcing portions are each formed by an elongated strip that extends from the lacing hole reinforcing portion to the featherline of the vamp in the mid-tarsal region of the medial and lateral sides of the upper, respectively, and each is of a width and location sufficient to span to the lacing holes of a pair of lacing holes formed in the reinforcing portion.

According to a feature of the preferred embodiment, the pairs of lacing holes formed in the lacing hole reinforcing portion include widely-spaced pairs of holes and closely-spaced pairs of holes, the holes of the widely-spaced pairs of holes being located closer to the featherline than the holes of the closely-spaced pairs. Furthermore, the pairs of holes spanned by the medial and lateral reinforcing portions are widely-spaced pairs of holes.

The one-piece construction with single medial and lateral reinforcing strip simplifies manufacture and reduces costs associated therewith, without detracting from the overall appearance of the athletic shoe upper. The one-piece construction, together with the extra wide nature of the reinforcing strips and the wide setting of the lacing holes associated therewith minimize stretching and enable greater tensioning to be applied to the foot with a resulting high degree of mid-foot control and arch support.

These and further objects, features and advantages of the present invention will become more obvious from the following description when taken in connection with the accompanying drawings which show, for purposes of illustration only, a single embodiment in accordance with the present invention.

DETAILED DESCRIPTION OF THE PREFERRED EMBODIMENT

Figure 1:
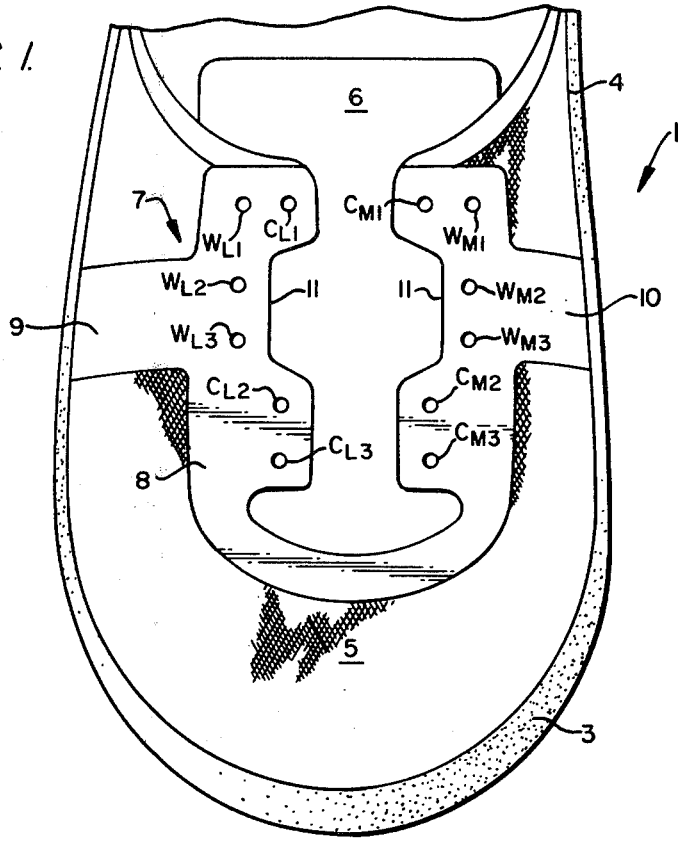
FIG. 1 is a partial, frontal perspective view of an athletic shoe embodying an upper construction in accordance with the present invention.
Figure 2:
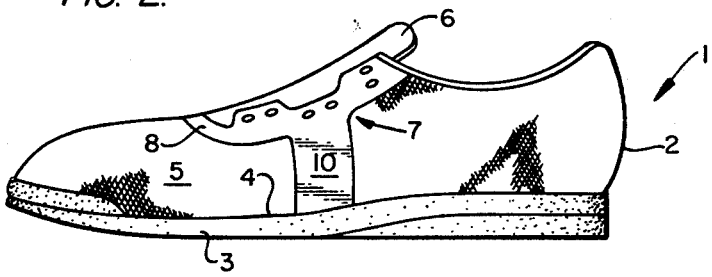
FIG. 2 is a side view of an athletic shoe equipped with the upper construction of FIG. 1.

With reference to FIGS. 1 and 2, an athletic shoe is indicated generally at 1 and has an upper 2 and a sole 3. The upper 2 is joined to the sole 3 along the featherline 4 (i.e., lower peripheral margin of the upper 2). Located underneath the elongated throat opening of the vamp 5 is a shoe tongue 6, an mounted on the vamp is a one-piece reinforcement 7 formed of a non-stretchable material, such as a leather or pigskin.

The reinforcement 7 comprises a lacing hole reinforcing portion 8, a lateral (i.e., outer side) reinforcing portion 9 and a medial (i.e., inner side) reinforcing portion 10, and is secured to the upper 2, such as by stitching along the edges thereof with thread of nylon or other high strength materials.

The lacing hole reinforcing portion 8 is secured to the vamp 5 adjacent to and surrounding the throat opening, and is provided with a plurality of pairs of lacing holes, the holes of each pair of holes being located on opposite sides of the throat opening. These pairs of lacing holes include widely-spaced pairs of holes w and closely-spaced pairs of holes c. The rearwardmost pair of closely-spaced holes $c_{L1}$, $c_{M1}$ are located at the top of the throat between a pair of widely-spaced holes $w_{L1}$, $w_{M1}$. In lacing of the shoe 1, either the closely-spaced pair $c_{L1}$, $c_{M1}$ will be utilized or the widely-spaced pair $w_{L1}$, $w_{M1}$ will be utilized, depending on the relative size and shape of the wearer's foot, in order to enable the tightest and most effective closure of the top of the throat of the upper of the athletic shoe. Thus, the lacing arrangement of the lacing hole reinforcing portion 8, as shown in the illustrated embodiment, utilizes only five pairs of holes. Forwardly and in line with holes $w_{L1}$, $w_{M1}$, are two further pairs of widely-spaced holes $w_{L2}$, $w_{M2}$ and $w_{L3}$, $w_{M3}$, for reasons set forth below in greater detail. Forwardly of these two pairs of widely-spaced holes are two further pairs of closely-spaced holes $c_{L2}$, $c_{M2}$ and $c_{L3}$, $c_{M3}$, which are in alignment with the closely-spaced pair of holes $c_{L1}$, $C_{M1}$. Furthermore, the throat opening is locally widened in the vicinity of the pairs of widely-spaced holes $w_{L2}$, $w_{M2}$ and $w_{L3}$, $w_{M3}$, so as to come into close proximity with these holes as shown at 11. Elimination of the material of the vamp and reinforcing portion 8 in areas 11 facilitates tightening of the laces as fully as possible, and creates a distinctive box-like appearance to this portion of the lacing reinforcing portion 8.

As also shown in the drawings, lateral reinforcing portion 9 is an elongated strip that extends from the lacing hole reinforcing portion 8 to the featherline 4 of vamp 5 in the mid-tarsal region of the lateral side of the vamp. Furthermore, the lateral reinforcing portion is of a width and location, with respect to the lateral side lacing holes $w_{L2}$ and $w_{L3}$ of these widely-spaced hole pairs as to be sufficient to span same, and preferably, span a distance greater than that of the diameter of these holes and the spacing therebetween. In this regard, since the distance spanned by the holes and the space therebetween is conventionally on the order of $\frac{3}{4}$ inch, the width of the lateral reinforcing strip may be from $\frac{3}{4}$ inch to $1\frac{1}{2}$ inches and, preferably, around 1 inch. It is also pointed out that, while the illustrated embodiment is a five hole lacing arrangement, athletic shoes are known to use lacing arrangements having from 4 to 7 pairs of lacing holes extending along the throat of the vamp, and the arrangement shown in the drawings can be modified so as to be shortened to a four hole arrangement or increased to a seven hole arrangement merely by adding further pairs of closely-spaced lacing holes, and extending or shortening the throat and reinforcing portion 8 as appropriate, without affecting the size and position of the lateral reinforcing portion 9 and widely-spaced holes $w_{L2}$ and $w_{L3}$. Similarly, the medial reinforcing portion 10 extends from the lacing hole reinforcing portion 8 to the featherline 4 of the vamp 5 in the mid-tarsal region of the medial side of the vamp, and is of a width and location with respect to the holes $w_{M2}$ and $w_{M3}$ sufficient to span same, and, preferably, are wide enough to span a distance greater than that of the diameter of the holes of these two holes of the widely-spaced pairs, being approximately $\frac{3}{4}$ inch to $1\kappa$ inches, especially 1 inch, wide.

By the lateral and medial reinforcing portions being located in the mid-tarsal region, formed of one piece with the lacing hole reinforcing portion, and being at least as wide as two lacing holes, greater arch support and good mid-foot control can be obtained since a maximal amount of tension can be transmitted by the laces via the two lacing holes and reinforcing portion 8 to the featherline where the upper 2 is joined to the sole 3, without being subject to stretching as can occur when narrow reinforcing strips are connected to a separate lacing hole reinforcement by stitching. Attainment of these benefits are further facilitated by the fact that the widely-spaced pairs of holes (that are closer to the featherline of the vamp than the closely-spaced holes, which are spaced from each other at opposite sides of the throat at a conventional distance) are used to tension the medial and lateral reinforcing portions. On the other hand, the provision of the further, forwardly located, closely-spaced pairs of holes $c_{L2}$, $c_{M2}$ and $c_{L3}$, $c_{M3}$ ensures that the vamp can be tightly closed for proper fitting of the upper to the wearer's foot.

While I have shown and described a single embodiment in accordance with the present invention, it is understood that the same is not limited thereto, but is susceptible of numerous changes and modifications as known to those skilled in the art, and I, therefore, do not wish to be limited to the details shown and described herein, but intend to cover all such changes and modifications as are encompassed by the scope of the appended claims.

I claim:

1. An athletic shoe upper construction comprising a vamp with an elongated throat opening, and a one-piece reinforcement of non-stretchable material having a lacing hole reinforcing portion, a medial reinforcing portion, and a lateral reinforcing portion; wherein said lacing hole reinforcing portion is secured to said vamp adjacent to and surrounding said throat opening and is provided with a plurality of pairs of lacing holes, the holes of each pair of holes being located on opposite sides of said throat opening; wherein said medial reinforcing portion is an elongated strip extending from said lacing hole reinforcing portion to the featherline of said vamp in the mid-tarsal region of the medial side of said vamp, and is of a width and location with respect to the medial side lacing holes of an adjacent two of said pairs of lacing holes sufficient to span same; wherein said lateral reinforcing portion is an elongated strip extending from said lacing hole reinforcing portion to the featherline of said vamp in the mid-tarsal region of the lateral side of said vamp, and is of a width and location with respect to the lateral side lacing holes of said adjacent two pairs of lacing holes sufficient to span same; and wherein said pairs of lacing holes comprise widely-spaced pairs of holes and closely-spaced pairs of holes, the holes of the widely-spaced pairs of holes being located closer to said featherline than the holes of the closely-spaced pairs; and wherein the pairs of holes spanned by said medial and lateral reinforcing portions are widely-spaced pairs of holes.

2. An athletic shoe upper construction according to claim 1, wherein at least one pair of said closely-spaced holes is located rearwardly adjacent to said pairs of widely-spaced holes spanned by said medial and lateral reinforcing portions; and wherein at least one pair of said closely-spaced holes is located forwardly adjacent to said pairs of widely-spaced holes spanned by said medial and lateral reinforcing portions.

3. An athletic shoe upper construction according to claim 2, wherein said at least one pair of closely-spaced holes located rearwardly of the pairs of holes spanned by the medial and lateral reinforcing portions is located at the top of said throat opening and has each of its lacing holes positioned between said throat opening and a respective lacing hole of a pair of widely-spaced holes located at the top of the throat opening, whereby either the closely-spaced or the widely-spaced pair of holes at the top of the opening are selectively utilized for obtaining the most effective closure of the top of the throat, depending on the shape and size of a wearer's foot.

4. An athletic shoe upper construction according to claim 2, wherein at least two pairs of closely-spaced holes are consecutively positioned forwardly of the widely-spaced holes spanned by the medial and lateral reinforcing portions.

5. An athletic shoe upper construction according to claim 1 or 2 or 3 or 4, wherein said throat opening is locally widened in the vicinity of the pairs of widely-spaced holes spanned by the medial and lateral reinforcing portions so as to come into close proximity thereto.

6. An athletic shoe upper construction according to claim 5, wherein said medial and lateral reinforcing portions are approximately $\frac{3}{4}''$ to $1\frac{1}{2}''$ wide.

7. An athletic shoe upper construction according to claim 5, wherein the medial and lateral reinforcing portions are wide enough to span a distance greater than that of the diameter of the holes of said two pairs of widely-spaced pairs of holes and the space therebetween.

8. An athletic shoe upper construction according to claim 5, wherein said medial and lateral reinforcing portions are approximately 1" wide and said distance is approximately $\frac{3}{4}''$.

* * * * *